US009167852B2

(12) United States Patent
Xiu

(10) Patent No.: US 9,167,852 B2
(45) Date of Patent: Oct. 27, 2015

(54) COMBINED MULTIFUNCTIONAL ELECTRONIC SIMULATED CIGARETTE

(76) Inventor: Yunqiang Xiu, Shandong (CN)

( * ) Notice: Subject to any disclaimer, the term of this patent is extended or adjusted under 35 U.S.C. 154(b) by 876 days.

(21) Appl. No.: 13/500,165

(22) PCT Filed: Jun. 12, 2010

(86) PCT No.: PCT/CN2010/000844
§ 371 (c)(1),
(2), (4) Date: Apr. 4, 2012

(87) PCT Pub. No.: WO2011/130886
PCT Pub. Date: Oct. 27, 2011

(65) Prior Publication Data

US 2012/0204889 A1 Aug. 16, 2012

(30) Foreign Application Priority Data

Apr. 22, 2010 (CN) ..... 2010 1 0153118

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 5,060,671 A * 10/1991 Counts et al. ..... 131/329
2012/0006342 A1* 1/2012 Rose et al. ..... 131/273

FOREIGN PATENT DOCUMENTS

WO PCT/CN2010/000844 1/2011

* cited by examiner

*Primary Examiner* — Michael J Felton
(74) *Attorney, Agent, or Firm* — Tianhua Gu; Global IP Services

(57) ABSTRACT

The invention claims a combined multifunctional electronic simulated cigarette, comprising an indicator, wherein the indicator is provided with a air inlet hole; one end of the indicator is connected with one end of an aroma generator; a first switch and a first battery are arranged between the indicator and the aroma generator; a solid aromatic substance is arranged in the aroma generator and is provided with electric heating wires; the other end of the aroma generator is connected with one end of a smoke capsule; solid adsorption cotton adsorbed with nicotine is arranged in the smoke capsule; the other end of the smoke capsule is connected with a suction nozzle which is provided with a suction hole. The invention can provide users with aromatic gases, nicotine component and simulated smoke simultaneously; and the users can respectively choose to inhale the aromatic gases, the nicotine component and the simulated smoke according to the needs, and the invention can meet the needs of the users or the smoking quitters in different stages, help the users to gradually reduce the suction amount of nicotine, and finally achieve the purpose of not taking in nicotine.

14 Claims, 2 Drawing Sheets

COMBINED MULTIFUNCTIONAL ELECTRONIC SIMULATED CIGARETTE

CROSS REFERENCE TO RELATED PATENT APPLICATION

The present application is the US national stage of PCT/CN2010/000844 filed on Jun. 12, 2010 which claims the priority of the Chinese patent application No. 201010153118.X filed on Apr. 22, 2010, which application is incorporated herein by reference.

FIELD OF THE INVENTION

The invention claims a simulated cigarette, specifically a combined multifunctional electronic simulated cigarette.

BACKGROUND OF THE INVENTION

It is generally held by the public that smoking is harmful to human health; however, the nicotine in cigarette make smokers depend on cigarettes, which is one critical reason for smokers difficultly quitting smoking. Therefore, the simulated cigarette without nicotine, incapable of replacing the traditional cigarette, fails to meet the demands of smoking quitters at different stages. Additionally, some simulated cigarettes containing nicotine are likely to meet nicotine intake demand, but cannot reduce the dependence of smokers on nicotine while smoking the cigarette. Thus, it fails to assist smokers to quit smoking. Due to the above mentioned disadvantages of simulated cigarette, the electronic simulated cigarette, aiming at quitting smoking or replacing the present cigarette, has not been popularized yet.

SUMMARY OF THE INVENTION

The combined multifunctional electronic simulated cigarette in the present invention can provide users with aromatic gases, nicotine component and simulated smoke simultaneously, and the users can respectively choose to take in the aromatic gases, the nicotine component or the simulated smoke according to the needs, and the invention can meet the needs of the users or the smoking quitters at different stages, help the users to gradually reduce nicotine intake amount, and finally achieve the purpose of not taking in nicotine.

For the above purpose, the invention is carried out through the following technical solution. The simulated cigarette comprises an indicator; the indicator is provided with an air inlet hole; one end of the indicator is connected with one end of an aroma generator; a first switch and a first battery are installed between the indicator and the aroma generator; a solid aromatic substance is arranged in the aroma generator and is provided with electric heating wires; the other end of the aroma generator is connected with one end of a smoke capsule; solid adsorption cotton adsorbed with nicotine is arranged in the smoke capsule; and the other end of the smoke capsule is connected with a suction nozzle which is provided with a suction hole. A rotary switch is installed at one end of the indicator; an indicator lamp cover is installed on the rotary switch; and a first indicator lamp and a second indicator lamp are installed in the indicator lamp cover. The smoke capsule is composed of a first smoke capsule shell and a second smoke capsule shell which are mutually connected, a first insert tube is arranged in the first smoke capsule shell; a second insert tube is arranged in the second smoke capsule shell; the solid adsorption cotton is installed in a cylindrical smoke capsule shell; and sealing aluminum foil films are arranged at two ends of the cylindrical smoke capsule shell. A controller is installed in the indicator; and a dynamic indicator lamp set is installed on the controller. The indicator appears tobacco pipe-shaped. The smoke capsule appears conical. Said solid aromatic substance is composed of the following raw materials based on weight ratio: 15.5 wt. % of *Mentha haplocalyx,* 12 wt. % of fructus amomi, 12 wt. % of *Syzygium aromaticum,* 12 wt. % of cinnamon, 10 wt. % of rhizoma zingiberis, 10 wt. % of Pricklyash Peel, 12 wt. % of *Foeniculum vulgare,* 1.5 wt. % of vanillin, 12 wt. % of Ethyl Maltol, 1.5 wt. % of linalool extract, 0.5 wt. % of aromatic tobacco essential oil, 0.5 wt. % of Bulgaria rose oil, and 0.5 wt. % of Yunnan flue-cured tobacco essential oil. An atomization power source device is installed between the smoke capsule and the suction nozzle; a second switch and a power source are installed in the atomization power source device; the suction nozzle is provided with liquid adsorbing cotton containing atomized liquid; and the liquid adsorbing cotton is provided with atomized heating wires which are connected with the atomization power source device. The atomized liquid in said liquid adsorbing cotton is composed of raw materials based on the following weight ratio: 70-80 wt. % of glycerol and 20-30 wt. % of water. Additionally, 0.6-2.4 wt. % of nicotine is added in the raw materials of atomized liquid.

The advantages of the invention are as follows: the invention can provide users with aromatic gases, the nicotine component and simulated smoke simultaneously; the users can respectively choose to take in the aromatic gases, the nicotine component and the simulated smoke according to the needs, and the invention can meet the needs of the users or the smoking quitters in different stages; it is featured with high simulation; the users are capable of showing whether the simulated cigarette in-service contains nicotine component or not through selecting the indicator lamps with different colors; moreover, it helps the users to gradually reduce nicotine intake amount, finally achieving the purpose of not taking in nicotine.

DETAIL DESCRIPTION OF THE INVENTION

Figure 1:
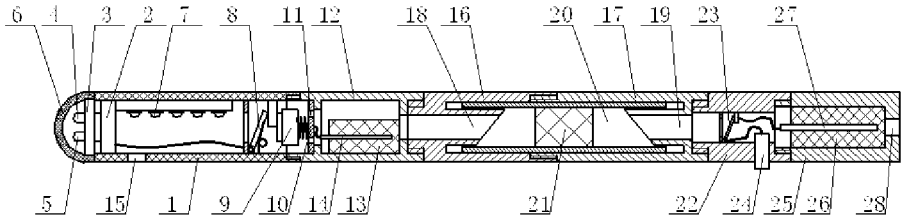
FIG. 1 shows the structure of the invention.
Figure 2:
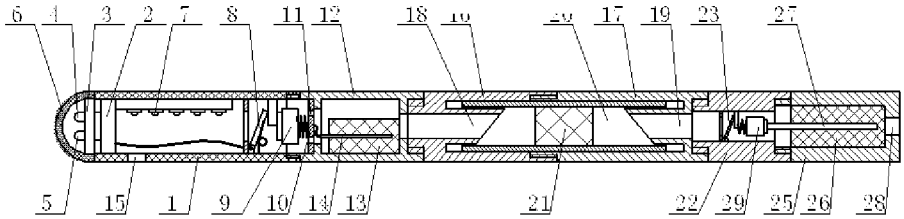
FIG. 2 shows the structure of another example.
Figure 3:
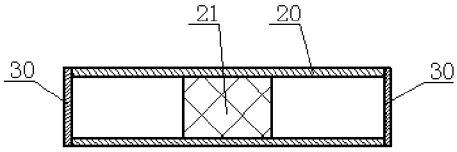
FIG. 3 shows the structure of smoke magazine in the invention.
Figure 4:
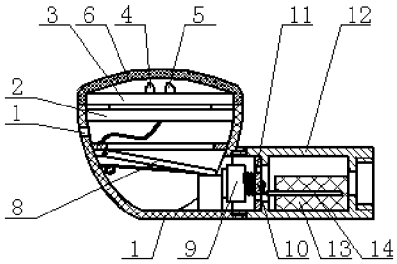
FIG. 4 shows the structure of the tobacco pipe-shaped indicator.
Figure 5:
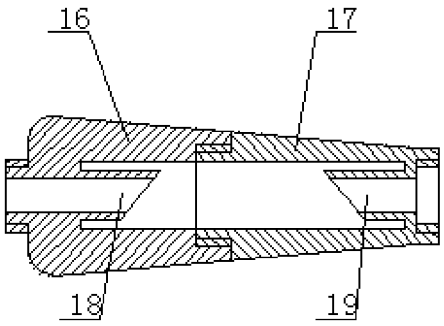
FIG. 5 shows the structure of the conical smoke capsule.
Figure 6:
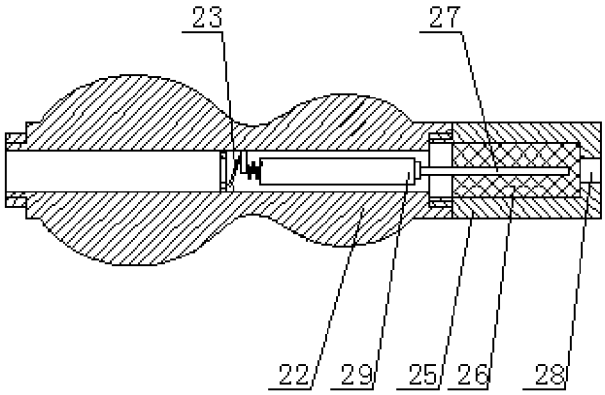
FIG. 6 shows the structure of the gourd-shaped atomization power source device.

The combined multifunctional electronic simulated cigarette of the invention comprises an indicator (1); the indicator (1) is provided with a gas inlet hole (15), one end of the indicator (1) is connected with one end of an aroma generator (12), a first switch (8) and a first battery (9) are arranged between the indicator (1) and the aroma generator (12), a solid aromatic substance (13) is arranged in the aroma generator (12) and is provided with electric heating wires (14), the other end of the aroma generator (12) is connected with one end of a smoke capsule, solid adsorption cotton (21) adsorbed with nicotine is arranged in the smoke capsule, and the other end of the smoke capsule is connected with a suction nozzle (25) which is provided with a suction hole (28). The gas enters the interior of simulated cigarette via the gas inlet hole (15) when the user inhales gases. When the gas passes through the first switch (8), the first switch (8) is capable of closing the power supply circuit of electric heating wires (14) to heat the solid aromatic substance (13). After the solid aromatic substance (13) is heated, the aromatic gas enters the smoke capsule along with the gas flow, which is mixed with nicotine substance in solid adsorption cotton (21) to form mixed gases. Finally, the mixed gases are sucked into the body of users through the suction hole (28) on the suction nozzle (25). Said first switch (8) can be a pneumatic switch which is started through gas flow, or a voice operated switch which is started through the sound while the gas passes through the switch. The smoke capsule is in detachable connection with the aroma generator (12) and the suction nozzle (25), such as threaded connection, trough connection or fastener connection. If the users are not required to suck nicotine, the smoke capsule can be dismantled, and the aroma generator (12) is connected the suction nozzle (25) to form the electronic simulated cigarette with aroma containing no nicotine component. The users are further capable of selecting to power on or power off the solid aromatic substance (13) according to their needs, thereby determining whether to take in aromatic gas.

The preferable structure of said indicator (1) is as follows: a rotary switch (3) is fixed at one end of the indicator (1); an indicator lamp cover (6) is installed on the rotary switch (3); a first indicator lamp (4) and a second indicator lamp (5) are arranged in the indicator lamp cover (6), wherein the first indicator lamp (4) and the second indicator lamp (5) are of different colors; when the user sucks the gas, the first switch (8) is switched off to close the indicator lamp power supply circuit; when the indicator lamp lights on, and simultaneously the electric heating wires (14) in the solid aromatic substance (13) are warmed up to stimulate the aroma; and the user is capable of lighting on and lighting off the first indicator lamp (4) and the second indicator lamp (5) through the rotary switch (3). Moreover, the indicator lamp in the above structure is capable of being lighted on while the user sucks gas, or being lighted off. In addition, in comparison with the existing similar products, the simulated cigarette in the invention, with higher simulation, is more similar to the real cigarette. Meanwhile, the structure is further advantaged in the capability of indicating the current operation status thereof. In other words, the user is capable of selecting to light up indicator lamps with different colors to show whether the simulated cigarette in-service contains nicotine component. The rotary switch (3) in the above technical solution can be replaced by a push switch. Of course, said indicator (1) in the invention can be of other structures. For instance, the rotary switch (3) in the preferable technical solution is not a necessity, and only utilizing one indicator lamp is acceptable. This technical solution is also provided with relatively high simulation. However, the user is not capable of selecting to light up indicator lamps of different colors to show whether the simulated cigarette in-service contains nicotine component.

For the convenience of replacing the solid adsorption cotton (21) in said smoke capsule, the invention can use the structure as follows: the smoke capsule is composed of the first smoke capsule shell (16) and the second smoke capsule shell (17) connected with each other; the first insert tube (18) is arranged in the first smoke capsule shell (16), while the second insert tube (18) is arranged in the second smoke capsule shell (17); the solid adsorption cotton (21) is installed in the cylindrical smoke capsule (20); and sealing aluminum foil films (30) are arranged at two ends of the cylindrical smoke capsule shell (20). Once required to replace the solid adsorption cotton (21), the smoke capsule shell (20) can be taken out after separating the first smoke capsule shell (16) and the second smoke capsule shell (17). Furthermore, the smoke capsule shell (20) and the sealing aluminum foil films (30) play a role in preventing the liquid evaporation in the solid adsorption cotton (21) for storage. The first insert tube (18) and the second insert tube (19) are applied to pierce the sealing aluminum foil films (30).

For further improvement in simulation, the controller (2) can be arranged in the indicator (1); the dynamic indicator lamp set (7) is installed on the controller (2) and composed of multiple transversely arranged indicator lamps. The first battery (9) supplies power for it. When the user inhales gas, the dynamic indicator lamp set (7) is powered off and the indicator lamps are lighted on and off under the control of the controller (2) to simulate the gradually burned out cigarette while smoking. With the above technical solution, the shell of said indicator (1) is made of a transparent material, or an opaque groove can be opened on a nontransparent material.

In order to meet the demands of users at different levels, the indicator (1) can be of tobacco-pipe shape. On top of meeting the needs of routine smoking, said simulated cigarette in the present invention can further be sold as handicraft articles. Additionally, said indicator (1) can also be of cylindrical or else. The cylindrical simulated cigarette is similar to the ordinary cigarette, in concordance with the habit of users.

The appearance of said smoke capsule can be made into various shapes as required, e.g. conical or cylindrical. The conical cigarette, with antiskid effect, is more suitable with the posture of the user holding the cigarette, and the user is more comfortable while using. While the overall appearance of the cylindrical simulated cigarette is identical to that of the ordinary cigarette, in concordance with the habit of users.

Said solid aromatic substance (13) can be made of raw materials capable of emanating aroma. The preferable weight ratio of the raw material is as follows: 15.5 wt. % of *Mentha haplocalyx,* 12 wt. % of fructus amomi, 12 wt. % of *Syzygium aromaticum,* 12 wt. % of cinnamon, 10 wt. % of rhizoma zingiberis, 10 wt. % of Pricklyash Peel, 12 wt. % of *Foeniculum vulgare,* 1.5 wt. % of vanillin, 12 wt. % of Ethyl Maltol, 1.5 wt. % of linalool extract, 0.5 wt. % of aromatic tobacco essential oil, 0.5 wt. % of Bulgaria rose oil, and 0.5 wt. % of Yunnan flue-cured tobacco essential oil. The raw material consists of multiple Chinese herbal medicines and essential oil so that the solid aromatic substance (13) is advantaged in pure aroma and easy volatilization after being heated. Furthermore, some Chinese herbal medicines play a role in health care.

To get better smoke of the simulated cigarette, the atomization power source device (22) can be installed between the smoke capsule and the suction nozzle (25); a second switch (23) and a power source are arranged in the atomization power source device (22); the suction nozzle (25) is provided with liquid adsorption cotton (26); the liquid adsorption cotton (26) is adsorbed with atomized liquid composed of glycerol and water to make the atomized liquid generate atomization effect after being heated and expanded; the liquid adsorption cotton (26) is provided with atomized heating wires (27), and the atomized heating wires (27) are connected with atomization power source device (22). A second cell (29) can be arranged to directly supply power for the atomization power source device (22) in direct current. Alternatively, a mobile phone charging interface (24) can be electrically connected with external mobile phone power source to supply power for the atomized heating wires (27). When the user inhales gas, the gas flow passes through the second switch (23), and power supply circuit of atomized heating wires (27) can be switched off via the second switch (23); after powering on the atomized heating wires (27), the liquid adsorption cotton (26) is heated to make the atomized liquid generate excellent atomization effect, achieving the smoke effect of ordinary cigarette. The second switch (23) can be a pneumatic switch which is started through gas flow or a voice operated switch which is started through the sound while the gas passes through the switch.

Said atomized liquid is composed of raw materials based on the following weight ratio: 70-80 wt. % of glycerol and 20-30 wt. % of water. The combination of glycerol and water is capable of making the atomized liquid generate a lot of smoke to simulate the smoke effect of ordinary cigarette. The mixture of water and glycerol is not harmful to human health, without influencing the taste of simulated cigarette. The atomized liquid is composed of raw materials based on the following weight ratio:

1. 70 wt. % of glycerol and 30 wt. % of water;
2. 80 wt. % of glycerol and 20 wt. % of water;
3. 75 wt. % of glycerol and 25 wt. % of water.

When the smoke capsule is dismantled by the user for smoking, 0.6-2.4 wt. % of nicotine component can be added into the raw materials of atomized liquid to meet nicotine intake needs of those who hold a craving for tobacco, to the benefit of gradually reducing nicotine intake amount, finally achieving the purpose of not taking in nicotine. The weight ratio of nicotine added in the raw materials of atomized liquid is as follows:

1. 70 wt. % of glycerol, 29.4 wt. % of water and 0.6 wt. % of nicotine;
2. 70 wt. % of glycerol, 27.6 wt. % of water and 2.4 wt. % of nicotine;
3. 70 wt. % of glycerol, 28.5 wt. % of water and 1.5 wt. % of nicotine;
4. 69.4 wt. % of glycerol, 30 wt. % of water and 0.6 wt. % of nicotine;
5. 67.6 wt. % of glycerol, 30 wt. % of water and 2.4 wt. % of nicotine;
6. 68.5 wt. % of glycerol, 30 wt. % of water and 1.5 wt. % of nicotine;
7. 80 wt. % of glycerol, 19.4 wt. % of water and 0.6 wt. % of nicotine;
8. 78.8 wt. % of glycerol, 18.8 wt. % of water and 2.4 wt. % of nicotine;
9. 18.5 wt. % of glycerol, 20 wt. % of water and 1.5 wt. % of nicotine.

Said atomization power source device (22) can be cylindrical, gourd-shaped or else. The cylindrical simulated cigarette is identical to the ordinary cigarette, in concordance with the habit of users. The gourd-shaped simulated cigarette is capable of serving as an ornamental article and assisting the user to find the pipe end under dark conditions. If not taking in the simulated smoke, the user can power off the atomization power source device (22) to stop heating the atomized liquid through the atomized heating wires (27). At this moment, the gases getting out from the suction hole (28) are not atomized. In the figure, the component (10) is a clapboard and the component (11) is a vent hole.

What is claimed is:

1. A combined multifunctional electronic simulated cigarette comprising an indicator (1), wherein the indicator (1) is provided with a gas inlet hole (15); one end of the indicator (1) is connected with one end of an aroma generator (12); a first switch (8) and a first battery (9) are arranged between the indicator (1) and the aroma generator (12); a solid aromatic substance (13) is arranged in the aroma generator (12) and is provided with electric heating wires (14); the other end of the aroma generator (12) is connected with one end of a smoke capsule, solid adsorption cotton (21) adsorbed with nicotine is arranged in the smoke capsule; and the other end of the smoke capsule is connected with a suction nozzle (25) on which a suction hole (28) is provided.

2. The combined multifunctional electronic simulated cigarette according to claim 1, wherein a rotary switch (3) is installed at one end of the indicator (1); an indicator lamp cover (6) is installed on the rotary switch (3); and a first indicator lamp (4) and a second indicator lamp (5) are installed in the indicator lamp cover (6).

3. The combined multifunctional electronic simulated cigarette according to claim 1, wherein the smoke capsule is composed of a first smoke capsule shell (16) and a second smoke capsule shell (17) which are mutually connected; a first insert tube (18) is arranged in the first smoke capsule shell (16); a second insert tube (19) is arranged in the second smoke capsule shell (17); the solid adsorption cotton (21) is installed in a cylindrical smoke capsule shell (20); and sealing aluminum foil films (30) are arranged at two ends of the cylindrical smoke capsule shell (20).

4. The combined multifunctional electronic simulated cigarette according to claim 1, wherein a controller (2) is installed in the indicator (1); and a dynamic indicator lamp set (7) is fixed on the controller (2).

5. The combined multifunctional electronic simulated cigarette according to claim 1, wherein the indicator (1) is of tobacco-pipe shape.

6. The combined multifunctional electronic simulated cigarette according to claim 1, wherein the smoke capsule is cone-shaped.

7. The combined multifunctional electronic simulated cigarette according to claim 1, wherein said solid aromatic substance (13) is composed of the following raw materials based on weight ratio: 15.5 wt. % of Mentha haplocalyx, 12 wt. % of fructus amomi, 12 wt. % of *Syzygium aromaticum,* 12 wt. % of cinnamon, 10 wt. % of rhizoma zingiberis, 10 wt. % of Pricklyash Peel, 12 wt. % of *Foeniculum vulgare,* 1.5 wt. % of vanillin, 12 wt. % of Ethyl Maltol, 1.5 wt. % of linalool extract, 0.5 wt. % of aromatic tobacco essential oil, 0.5 wt. % of Bulgaria rose oil, and 0.5 wt. % of Yunnan flue-cured tobacco essential oil.

8. The combined multifunctional electronic simulated cigarette, according to claim 1, wherein an atomization power source device (22) is arranged between the smoke capsule and the suction nozzle (25); a second switch (23) and a power source are installed in the atomization power source device (22); the suction nozzle (25) is provided with liquid adsorbing cotton (26) containing atomized liquid; and the liquid adsorbing cotton (26) is provided with atomized heating wires (27) which are connected with the atomization power source device (22).

9. The combined multifunctional electronic simulated cigarette according to claim 8, wherein the atomized liquid in said liquid adsorbing cotton (26) is composed of raw materials based on the following weight ratio: 70-80 wt. % of glycerol and 20-30 wt. % of water.

10. The combined multifunctional electronic simulated cigarette according to claim 2, wherein a controller (2) is installed in the indicator (1); and a dynamic indicator lamp set (7) is fixed on the controller (2).

11. The combined multifunctional electronic simulated cigarette according to claim 2, wherein the indicator (1) is of tobacco-pipe shape.

12. The combined multifunctional electronic simulated cigarette according to claim 3, wherein the smoke capsule is cone-shaped.

13. The combined multifunctional electronic simulated cigarette, according to 3, wherein an atomization power source device (22) is arranged between the smoke capsule and the suction nozzle (25); a second switch (23) and a power source are installed in the atomization power source device (22); the suction nozzle (25) is provided with liquid adsorbing cotton (26) containing atomized liquid; and the liquid adsorbing cotton (26) is provided with atomized heating wires (27) which are connected with the atomization power source device (22).

14. The combined multifunctional electronic simulated cigarette according to claim 12, wherein the atomized liquid in said liquid adsorbing cotton (26) is composed of raw materials based on the following weight ratio: 70-80 wt. % of glycerol and 20-30 wt. % of water.

* * * * *